US008430239B2

(12) United States Patent
Shpiner

(10) Patent No.: US 8,430,239 B2
(45) Date of Patent: Apr. 30, 2013

(54) PROTECTIVE CARRYING CASE FOR PHOTOGRAPHIC EQUIPMENT

(76) Inventor: Steven B. Shpiner, Brookline, MA (US)

( * ) Notice: Subject to any disclaimer, the term of this patent is extended or adjusted under 35 U.S.C. 154(b) by 0 days.

(21) Appl. No.: 12/414,114

(22) Filed: Mar. 30, 2009

(65) Prior Publication Data

US 2010/0101968 A1 Apr. 29, 2010

Related U.S. Application Data

(60) Provisional application No. 61/041,405, filed on Apr. 1, 2008.

(51) Int. Cl.
*A45C 11/38* (2006.01)

(52) U.S. Cl.
USPC ..... 206/316.2; 206/822; 220/252

(58) Field of Classification Search ..... 206/316.1, 206/316.2, 316.3, 822, 349; 220/313, 345.6, 220/DIG. 6, 571, 219, 252, 254.3, 254.5; 224/908
See application file for complete search history.

(56) References Cited

U.S. PATENT DOCUMENTS

| | | | | |
|---|---|---|---|---|
| 2,223,219 | A * | 11/1940 | Mayerovitz | 206/316.2 |
| D174,536 | S | 4/1955 | Eckhardt et al. | |
| 2,827,095 | A | 3/1958 | Hepting | |
| 3,572,560 | A * | 3/1971 | Dolph | 206/316.1 |
| D234,982 | S | 4/1975 | Tomastsuri | |
| 3,910,470 | A | 10/1975 | Swenson et al. | |
| 4,162,696 | A | 7/1979 | Sprung | |
| D271,822 | S | 12/1983 | Clancy | |
| 4,461,411 | A | 7/1984 | Harrow | |
| 4,558,799 | A * | 12/1985 | Hammond | 220/826 |
| 4,649,973 | A | 3/1987 | Uchin | |
| 4,866,792 | A | 9/1989 | Arai | |
| 4,907,300 | A | 3/1990 | Dampney et al. | |
| D310,298 | S | 9/1990 | Fukushima | |
| 5,005,221 | A | 4/1991 | Chen | |
| 5,064,062 | A | 11/1991 | Miller | |
| 5,091,997 | A | 3/1992 | Foehl | |
| 5,095,551 | A | 3/1992 | Chin | |
| 5,139,165 | A * | 8/1992 | Hara | 206/316.1 |
| 5,172,838 | A | 12/1992 | Rowell et al. | |
| 5,219,085 | A * | 6/1993 | Craft et al. | 220/252 |
| 5,358,110 | A | 10/1994 | Simpson | |
| D361,428 | S | 8/1995 | Akabane et al. | |
| 5,467,480 | A | 11/1995 | Baudou et al. | |
| D378,163 | S | 2/1997 | Clissold | |
| D412,244 | S | 7/1999 | Miyahara | |
| D429,564 | S | 8/2000 | Carver | |

(Continued)

FOREIGN PATENT DOCUMENTS

WO WO 2007/084565 A2 7/2007

*Primary Examiner* — Andrew Perreault
(74) *Attorney, Agent, or Firm* — Hamilton, Brook, Smith & Reynolds, P.C.

(57) ABSTRACT

A carrying case for camera equipment comprising a base portion having a hard outer surface, the outer surface having a convex contour, and an inner surface, the inner surface being lined with a shock-absorbing material, and a cavity defined within the base portion, terminating in an opening, for receiving a camera and at least one camera lens; a lid portion having a hard outer surface and an inner surface, the inner surface being lined with a shock-absorbing material, the lid portion hingedly attached to the base portion; and a sealing member framing the opening to form a seal when the lid portion and the base portion are mated.

19 Claims, 8 Drawing Sheets

U.S. PATENT DOCUMENTS 6,189,725 B1 * 2/2001 Monico ..... 220/698
6,257,406 B1 * 7/2001 Garino ..... 206/315.9
6,540,098 B1 * 4/2003 Jarvis et al. ..... 220/345.4
6,641,878 B2 * 11/2003 Suzuki et al. ..... 206/316.1
6,877,169 B2 4/2005 Acquaviva
7,059,503 B2 6/2006 Andersen
7,677,166 B2 * 3/2010 Tsai ..... 206/524.8
7,703,631 B2 * 4/2010 Chafe et al. ..... 220/570
2005/0140331 A1 6/2005 McQuade
2005/0242143 A1 11/2005 Hassett
2006/0283737 A1 * 12/2006 Hassett ..... 206/316.2
2007/0295625 A1 12/2007 Bishop

* cited by examiner

PROTECTIVE CARRYING CASE FOR PHOTOGRAPHIC EQUIPMENT

RELATED APPLICATION

This application claims the benefit of U.S. Provisional Application No. 61/041,405, filed on Apr. 1, 2008. The entire teachings of the above application(s) are incorporated herein by reference.

BACKGROUND

Photographers and photographic enthusiasts have been gaining in numbers with the ubiquity and decreased cost of high end digital cameras. With this transition the photographic excellence potential once reserved for professionals is now accessible to the masses. The demographics of users and the activities of these new users have changed the needs for the photographic industry to offer new protection options for photographic equipment. These new users are generally younger and more active than traditional photographic enthusiasts. These more active lifestyles demand new protection options for photographic equipment; allowing for uses outdoors, while traveling and amidst the hustle and bustle of the city without the fear of damaging the equipment.

Photographic equipment by nature is delicate. The optics and internal electronics are sensitive to impact, vibration, abrasion and moisture damage.

For an active photographic enthusiast, there are times when it is necessary for a carrying case to allow easy access to the equipment stored inside, thus allowing short transition from stowed camera to shot capture. This is critical for the ability to capture the photograph of choice and to achieve photographic excellence.

Generally, the carrying cases currently on the market are soft and non-conforming in shape, thus leading to vulnerabilities in protection. These designs are also cumbersome, making quick access to photographic equipment difficult. As a result, the carrying cases currently on the market do not adequately protect expensive photographic equipment and fail to satisfy the needs of the active photographer.

SUMMARY

There is a need to provide users with a protective carrying case that is minimal in size, conforms to the contours of photographic equipment allowing for expanded usability of photographic equipment beyond what current protection options allow for as a result of their size, material, shape and equipment access method.

The present invention relates to a carrying case for camera equipment. In an embodiment, the case comprises a base portion having a hard outer surface, the outer surface having a convex contour, and an inner surface, the inner surface being lined with a shock-absorbing material, and a cavity defined within the base portion, terminating in an opening, for receiving a camera and at least one camera lens. The carrying case includes a lid portion having a hard outer surface and an inner surface, the inner surface being lined with a shock-absorbing material, the lid portion hingedly attached to the base portion. A sealing member frames the opening to form a seal when the lid portion and the base portion are mated.

In embodiments of the invention, the hard outer surface of the carrying case comprises a polymer or a reinforced polymer.

In a preferred embodiment the hard outer surface of the carrying case comprises a carbon fiber composite or composite blend.

In another preferred embodiment the hard outer surface of the carrying case comprises a bio-composite.

In embodiments of the invention the shock-absorbing material is a protective foam. In another embodiment, at least a portion of the shock-absorbing material is a flexible bladder.

The carrying case of the invention can also include an attachment member. The attachment member can be used to attach a transporting member. The transporting member can be a strapping means used to transport the carrying case or anything that a user wishes to carry along with the carrying case, such as, for example, a bottle of water, a jacket, binoculars, etc. In a preferred embodiment, the transporting member is a canister comprising a hard outer surface and an inner surface lined with a shock-absorbing material. This canister can be used to transport, for example, another camera lens or other photographic equipment.

In embodiments of the invention, the sealing member of the carrying case is a gasket. This gasket can be affixed to either the base portion, the lid portion, or both of the carrying case, such that when the base portion and the lid portion are mated, the gasket forms a substantially water-resistant seal.

In embodiments of the invention, the base portion further comprises a suspension system for securing the camera within the cavity. This suspension system provides even greater protection to the camera and the camera equipment within the carrying case.

In embodiments of the invention, the lid portion is attached to the base portion by a hinge at the top of the base.

In embodiments of the invention, the lid portion is attached to the base portion by a pivoting mechanism secured to opposite sides of the base.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
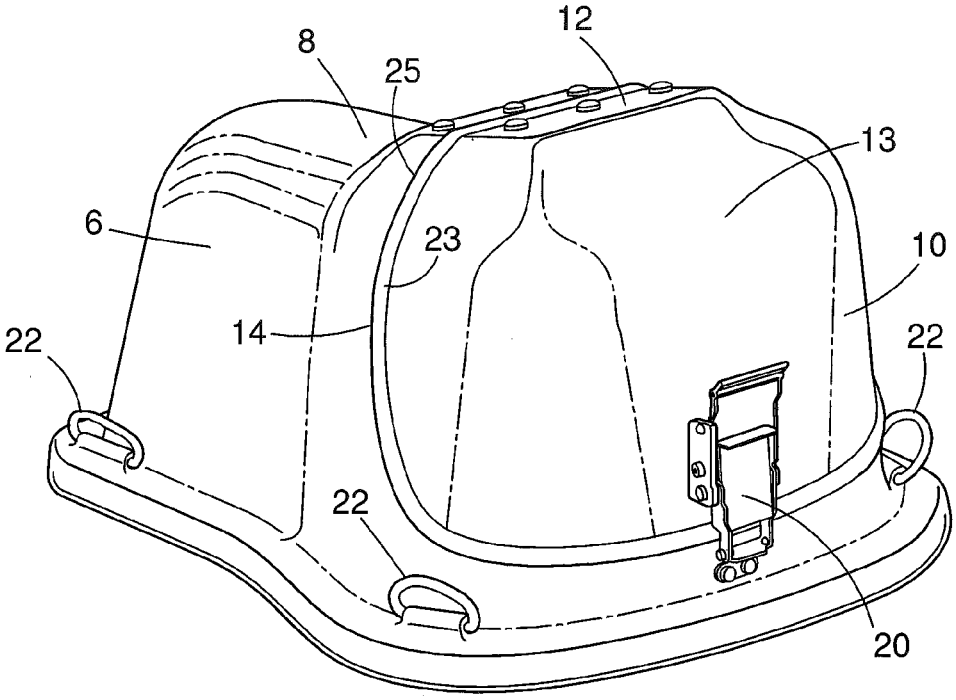
FIG. 1 is a perspective view of an embodiment of a carrying case.

A description of example embodiments of the invention follows.

An embodiment of the invention shown in FIGS. 1, 2A, and 3-5 is a carrying case 6 for camera equipment comprising a base portion 8 having a hard outer surface, wherein the carrying case is shaped similarly to the contours of a camera and camera lens. The carrying case terminates in an opening 7 giving access to an equipment storage cavity. The carrying case further comprises a lid 13 attached by a hinge 19 to the base portion 8. The lid portion and the base portion are mateable with a latch 20. Both the lid 13 and the opening of the base portion 7 are lined with a sealing member, e.g. a gasket 23. When the lid is closed, i.e., the lid and the base portion are mated, the sealing members form a substantially water-resistant seal, thus protecting the photographic equipment inside the carrying case from the elements.

The base portion 8 comprises a top portion 12 and a bottom portion 11. The top portion and the bottom portion are mated together using standard procedures known in the art.

In embodiments of the invention a front forward reign 9 of the carrying case 6 terminates in a flat edge as depicted in FIGS. 1, 2A, and 3-5. This flat edge concludes the forward extrusion of a convex contour 15 protruding from a second more pronounced convex contour 16.

At the top of an ellipsoidal rear reign 10 is where a hinge 19 allows for the user actuated opening of lid 13 giving access to the equipment storage cavity. When access to the enclosed equipment is not needed, lid 13 can remain in the closed position preventing access to the cavity by a latch 20 or other similar position retention device.

In embodiments of the invention, the sealing member of the carrying case is a gasket. This gasket can be affixed to either the base portion, the lid portion, or both of the carrying case, such that when the base portion and the lid portion are mated, the gasket forms a substantially water-resistant seal.

Figure 12:
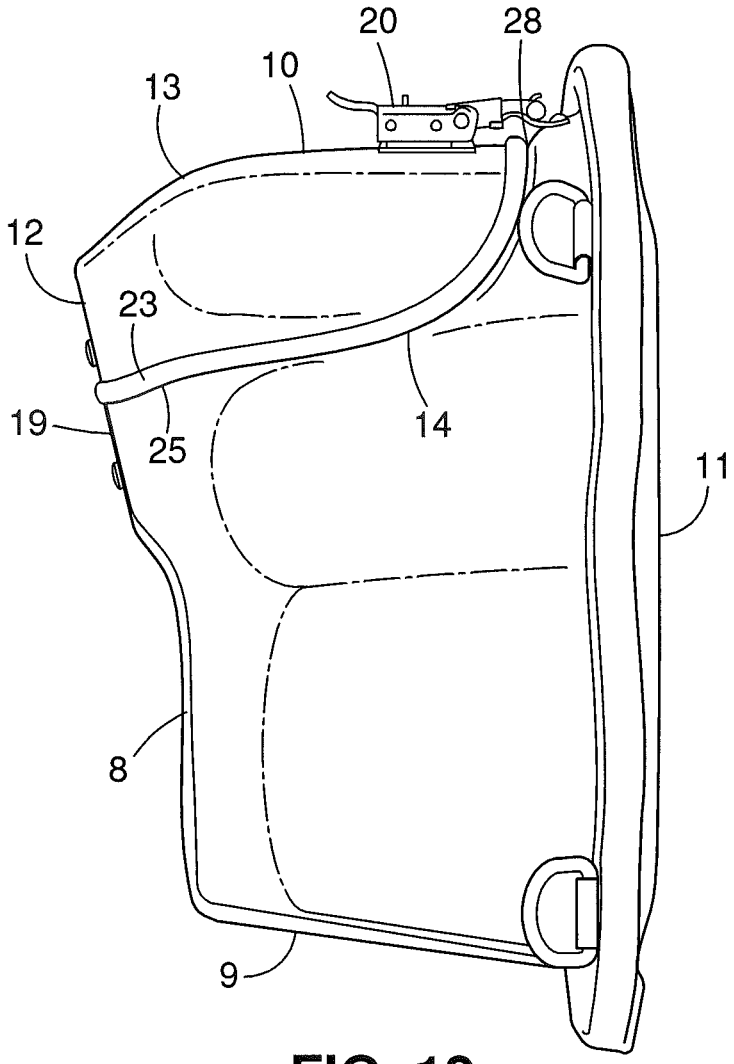
FIG. 12 is a side view of the carrying case of FIG. 3 in a vertical position.

In embodiments of the invention, when in the closed position, the lid 13 has a complete seal on base portion 8 along the meeting edge curve 14. The seal is created by forcing a connection between a sealing member 23 lining the lid against the sealing member 24 lining the opening of the base portion which is held within recessed edge 25 of the equipment storage cavity. This helps prevent the entry of foreign material and moisture from the cavity. The shape of the recessed edge 25 to the opening of the base portion 8 creates a dual layer of protection from the elements, and specifically from moisture. The shape of the recessed edge 25 creates a gutter in which liquid can flow away from the opening of the base portion 8. When the carrying case is held in the vertical position with lid 13 positioned upward (FIG. 12), any liquid within the recessed edge 25 is prevented from entering the carrying case 6 through the opening 7; instead the recessed edge forces liquid to drain toward the top reign 12 and toward the front reign 9.

This design also prevent liquid from entering the cavity when the carrying case is held in a different configuration or when the top of the carrying case 6 is exposed to a liquid. For example, if the user sets the carrying case down with the bottom 11 touching a surface, rain could fall on the carrying case and hit the top 12. If the rain comes in contact with the carrying case from the top, gravity would force the water toward the base 11, liquid would be able to flow in recessed channel 25 draining down and released at the extended lip 28. These features allow users to bring their equipment within the carrying case 6 into a potentially wet environment without fear of equipment damage while the carrying case is positioned in any orientation.

The embodiment depicted in FIGS. 1, 2A, and 3-5 also includes one or more attachment members 22. These attachment members are offered as attachment points for items such as for transportation members. Examples of attachment members include an anchor, ring, slot, eye pad or other similar device. Attachment members may be located around the periphery of the carrying case 6.

Transporting members include items that allow a user to carry the carrying case and include items that a user may wish to carry along with the carrying case. For example, a transporting member includes strapping devices. By variously configuring strapping devices a user can wear the carrying case 6 with an over the shoulder strap or a strap across the chest by connecting a strap to attachment points 22. The user can also utilize the attachment members to secure straps that can be used to position the carrying case on the front of the user's body, on the hip or on the user's back. Alternatively, a transporting member, such as a strapping device or a clip, can be used to attach the carrying case to another object, such as a back pack, hiking pack, golf bag, bicycle, ATV, stroller, or a snow mobile. This allows the user to take the carrying case on a variety of different outdoor activities such as participating in sports or while hiking Such options allow the carrying case to be firmly secured to the user or to another object and provides the user with fast, easy access to any equipment stored within the carrying case.

Transporting members also include, for example, items that a user might wish to carry along with the carrying case such as a bottle of water or binoculars. A transporting member further includes items such as a cargo net that allows the user to carry items on the carrying case such as a jacket, a book, or a wallet.

Figure 6:
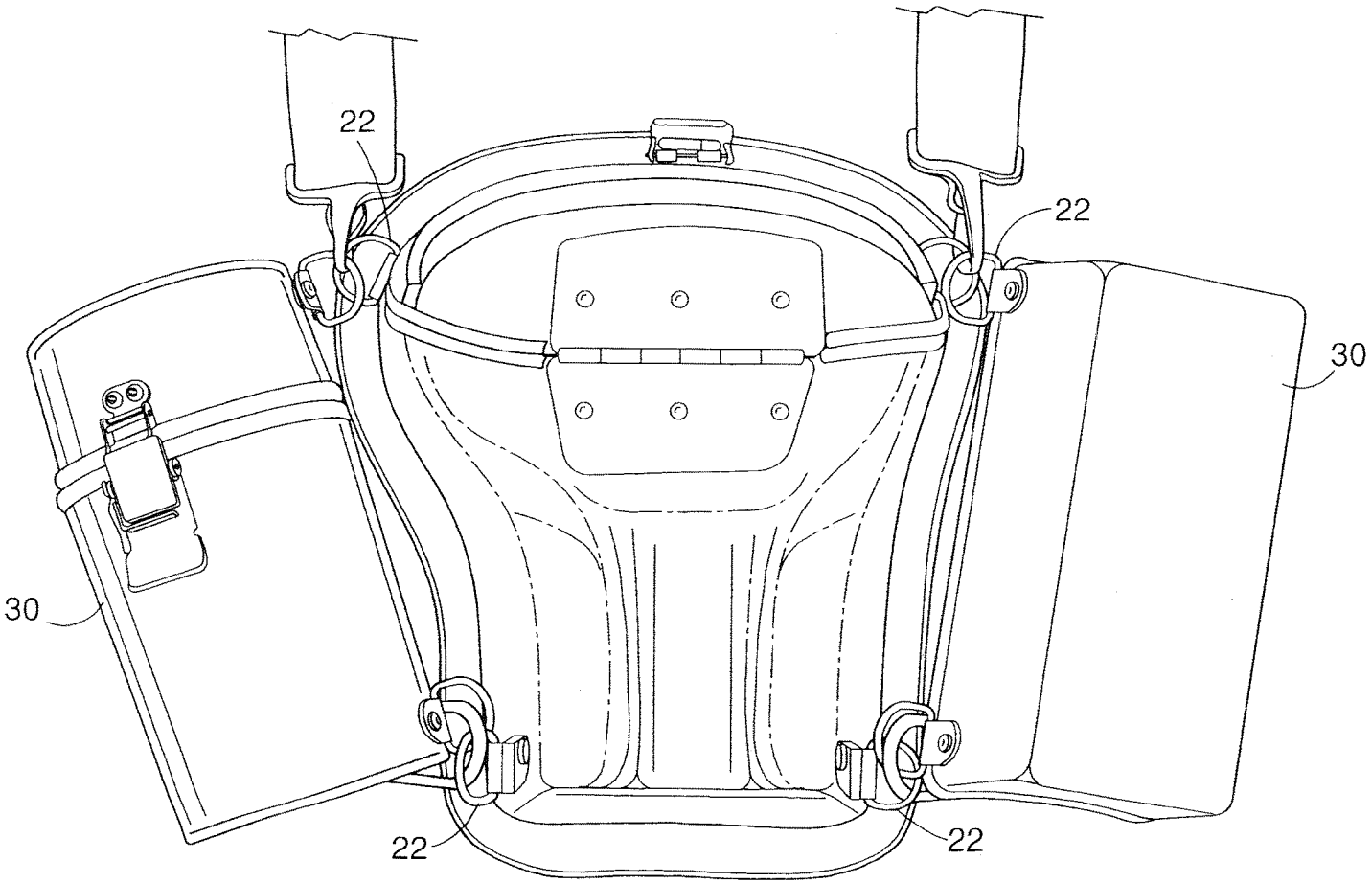
FIG. 6 is a top view of the carrying case with attached canisters.

In a preferred embodiment, the transporting member is a canister 30 comprising a hard outer surface and an inner surface lined with a shock-absorbing material. (See FIG. 6). This canister can be used to transport, for example, another camera lens or other photographic equipment.

In the embodiment depicted in FIGS. 1, 2A, and 3-5, the inner surface of the base portion 8 and the lid portion 13 are lined with shock-absorbing material to protect the photographic equipment stored within the cavity. This material follows the contours of the exterior of the carrying case 6 which follow the photography industry standard shape of photographic equipment. This allows for padded protection for all brands and models within the photographic industry's size categories. This protective material can be foam, sponge or other similar material made from a rubber, polymer or other appropriate material of sufficient thickness and density to protect the enclosed equipment.

Figure 2A:
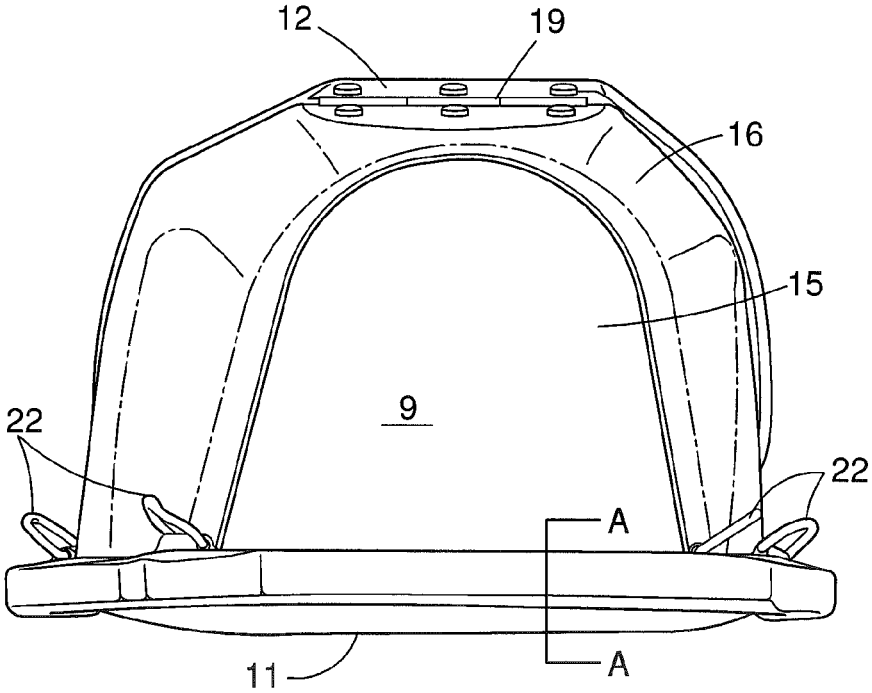
FIG. 2A is a front view of the carrying case of FIG. 1.
Figure 2B:
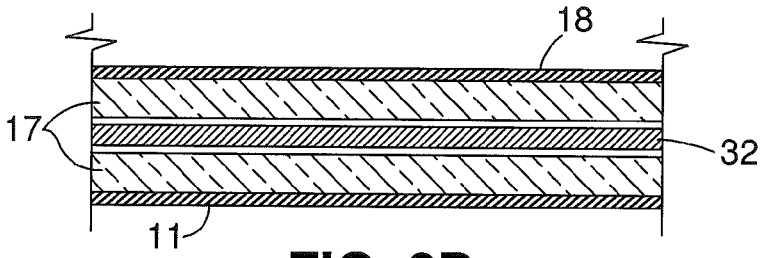
FIG. 2B is a simplified cross-sectional view taken along the lines A-A in FIG. 2A of an embodiment of the carrying case.
Figure 2C:
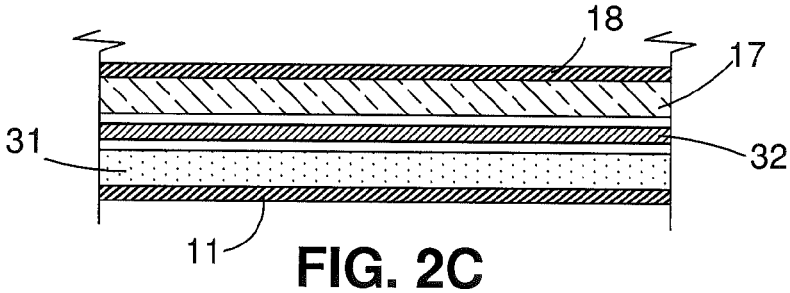
FIG. 2C is a simplified cross-sectional view taken along the lines A-A in FIG. 2A of another embodiment of the carrying case.
Figure 3:
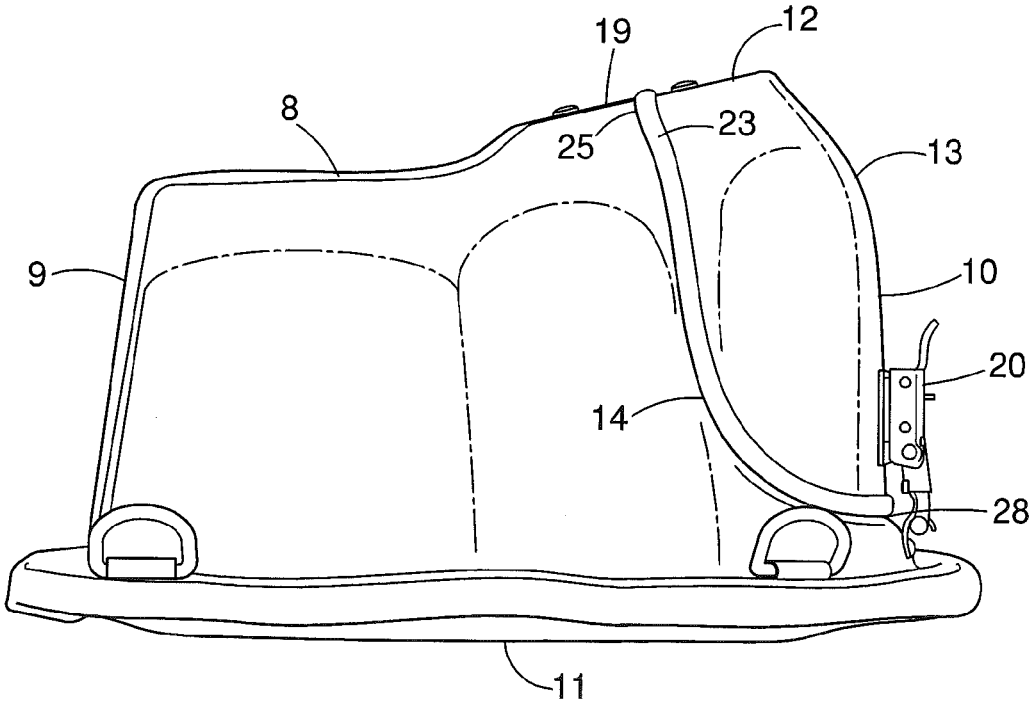
FIG. 3 is a side view of the carrying case of FIG. 1.

In embodiments of the invention, the bottom 11 of the base portion 8 is padded in the same way as the inner surface 18 so to add comfort to user when the carrying case 6 is strapped to a user's body while photographic equipment is in use or being stored (See FIGS. 2B and 2C). In these embodiments, the bottom 11 of the base portion comprises a first layer comprising a hard outer surface, then a second layer comprising shock-absorbing padding 17, then a third layer 32 comprising a hard material such as the material comprising the hard outer surface.

In embodiments of the invention, the hard outer surface of the carrying case comprises a polymer or a reinforced polymer. The use of polymers or reinforced polymers in creating a hard outer surface for a carrying case is well-known in the art. Any such polymers or reinforced polymers known in the art is suitable for use in the present invention.

In a preferred embodiment the hard outer surface of the carrying case comprises a composite. In another preferred embodiment, the composite is a carbon fiber composite. In another preferred embodiment, the composite is a bio-composite.

In another embodiment, at least a portion of the shock-absorbing material is a flexible bladder 31. For example, in one embodiment, the flexible bladder 31 forms a portion of the shock-absorbing material that lines the bottom 11 of the base portion. The flexible bladder 31 can be filled with a gas, such as air, gelatin, or a liquid, such as water. In embodiments having a liquid-filled bladder 31, the bladder is contained in the bottom 11 of the base portion, as depicted in FIG. 2C. This configuration eliminates the risk associated with the liquid-filled bladder leaking into the carrying case 6.

In yet another embodiment, wherein the flexible bladder 31 is filled with a liquid, such as water, the flexible bladder serves the dual purpose of providing padding and storing the liquid for use by the user of the carrying case. In preferred embodiments of the invention, the flexible bladder 31 is filled with water. In another preferred embodiment the flexible bladder is filled with water with a straw-like device extending from the bladder, allowing the user to drink the water stored in the flexible bladder. Another way in which the water can be accessed is through a single point of entry valve distribution method.

Figure 7:
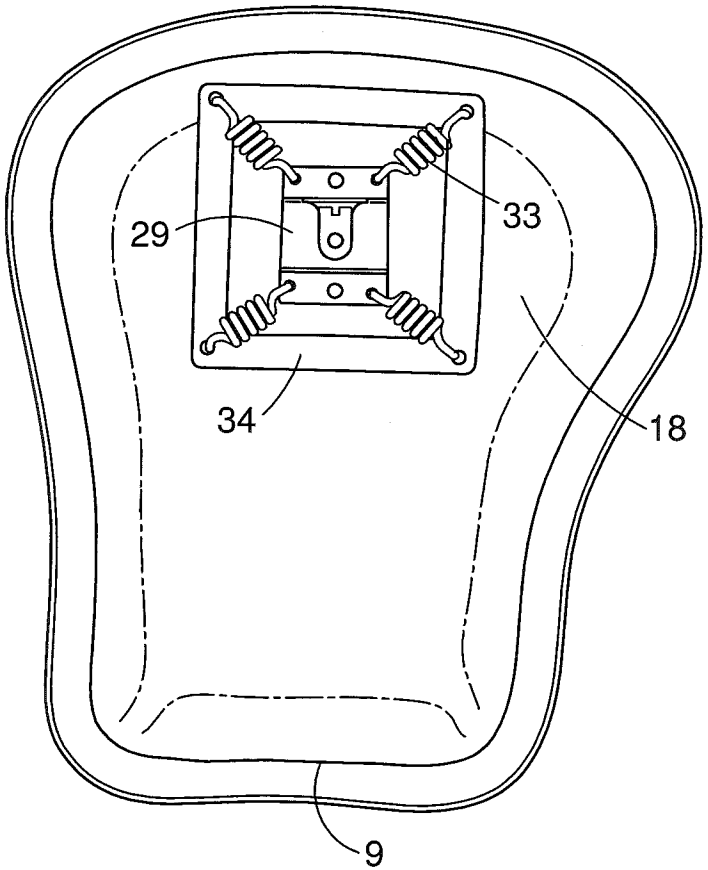
FIG. 7 is a top view of the inside portion of the bottom of the carrying case having a suspension system.
Figure 5:
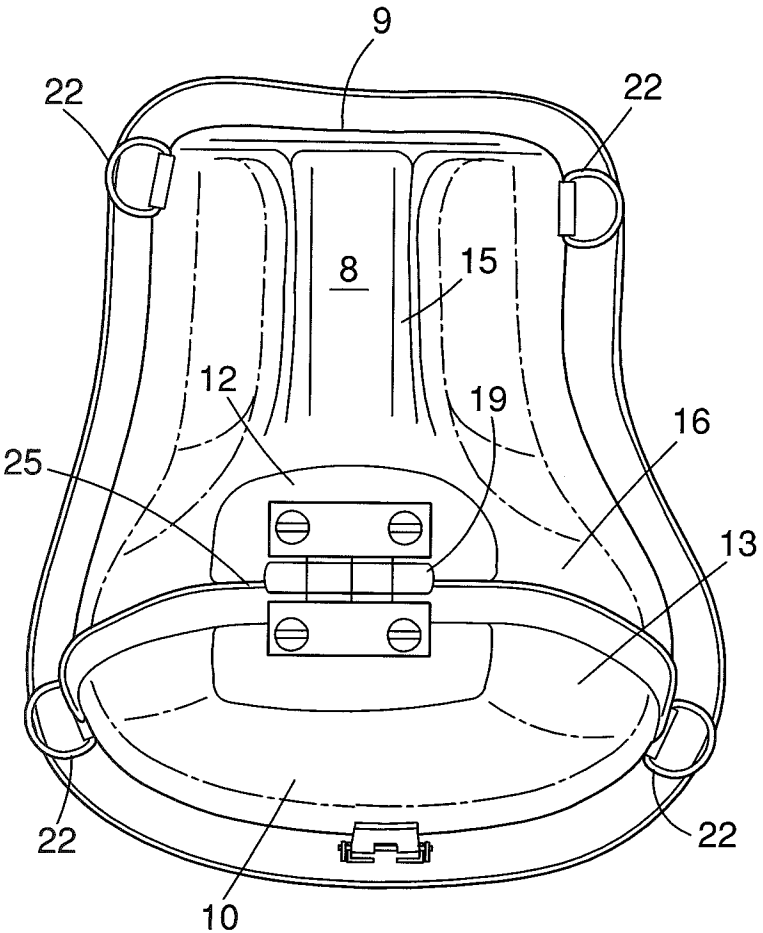
FIG. 5 is a top view of the carrying case of FIG. 1.

In embodiments of the invention, the base portion further comprises a suspension system 34 for securing the camera within the cavity. (See FIG. 7). The suspension system is mounted within the cavity of the carrying case. In a preferred embodiment, the suspension system is a spring or elastomer 33 based receptacle 29 designed to receive the photographic equipment. An extending pin is mounted to the bottom of the photographic equipment. This pin slides into and potentially locks into the spring or elastomer based receptacle mounted 34 on the interior surface 18 of the carrying case 6. This suspension system provides even greater protection to the camera and the camera equipment within the carrying case.

Figure 4:
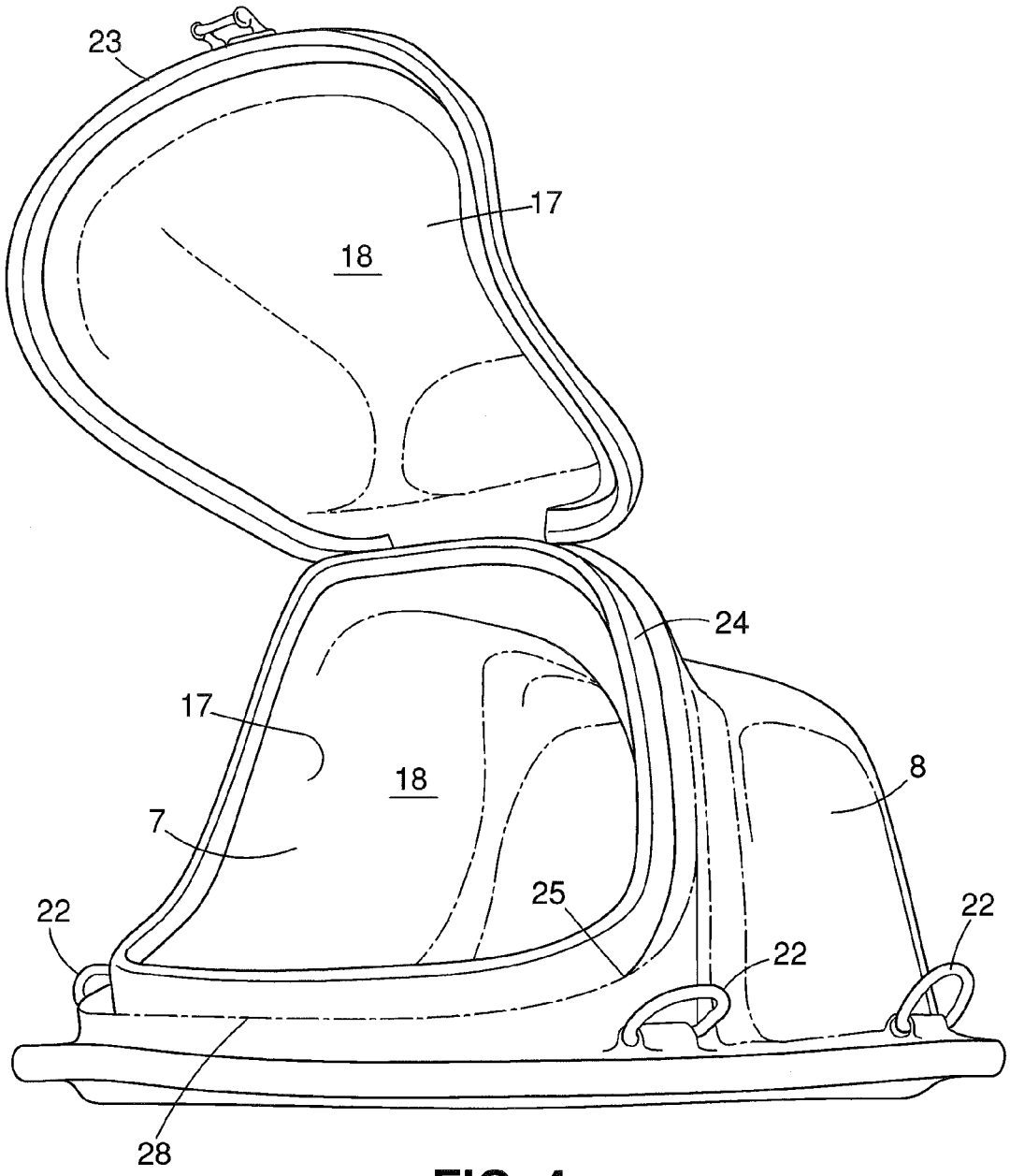
FIG. 4 is a perspective view with the lid in an open position for the carrying case of FIG. 1.

In the embodiment of the invention shown in FIG. 4, the lid portion 13 is attached to the base portion 8 by a hinge at the top of the base.

Figure 8:
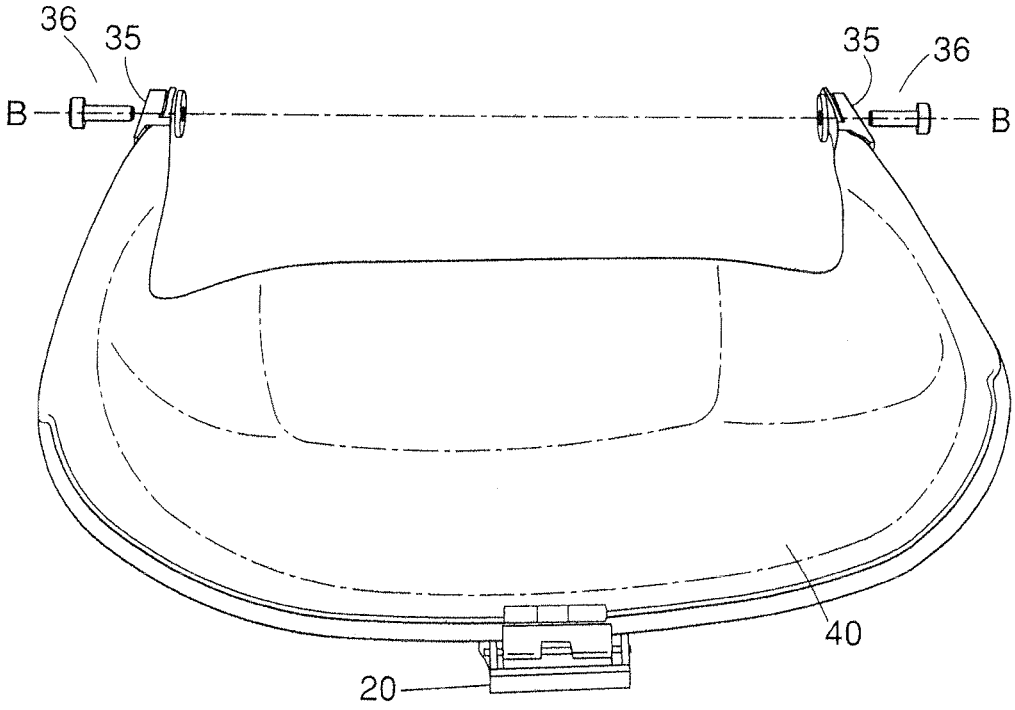
FIG. 8 is a partial top view of another embodiment of a lid for a carrying case.
Figure 9:
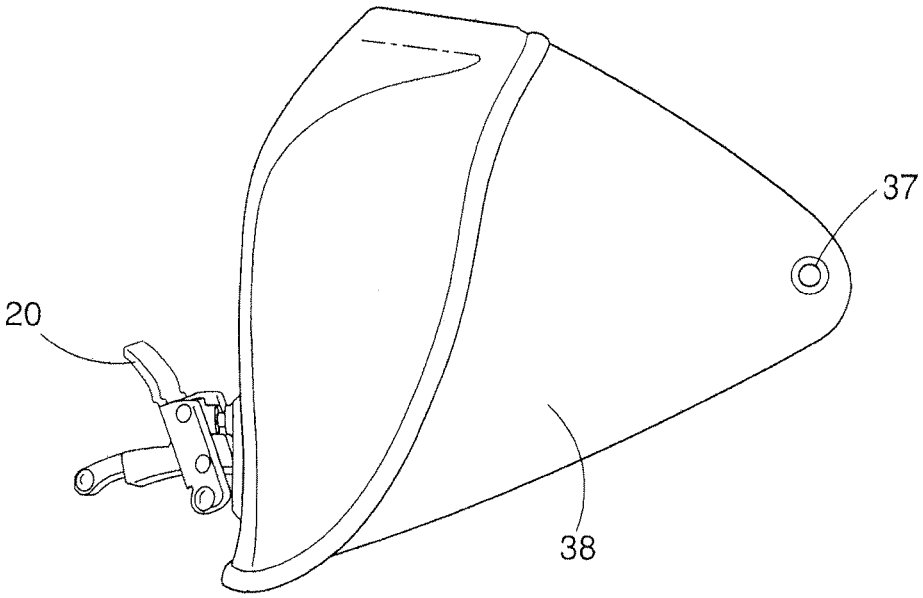
FIG. 9 is a side view of the lid of FIG. 8 featuring a side portion of the lid and a pivot point assembly.
Figure 10:
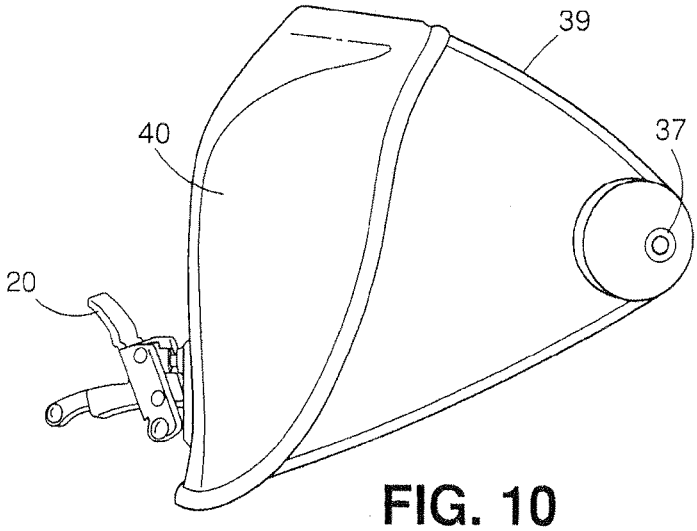
FIG. 10 is a side view of the lid of FIG. 8 featuring a lid support armature with pivot point assembly.
Figure 11:
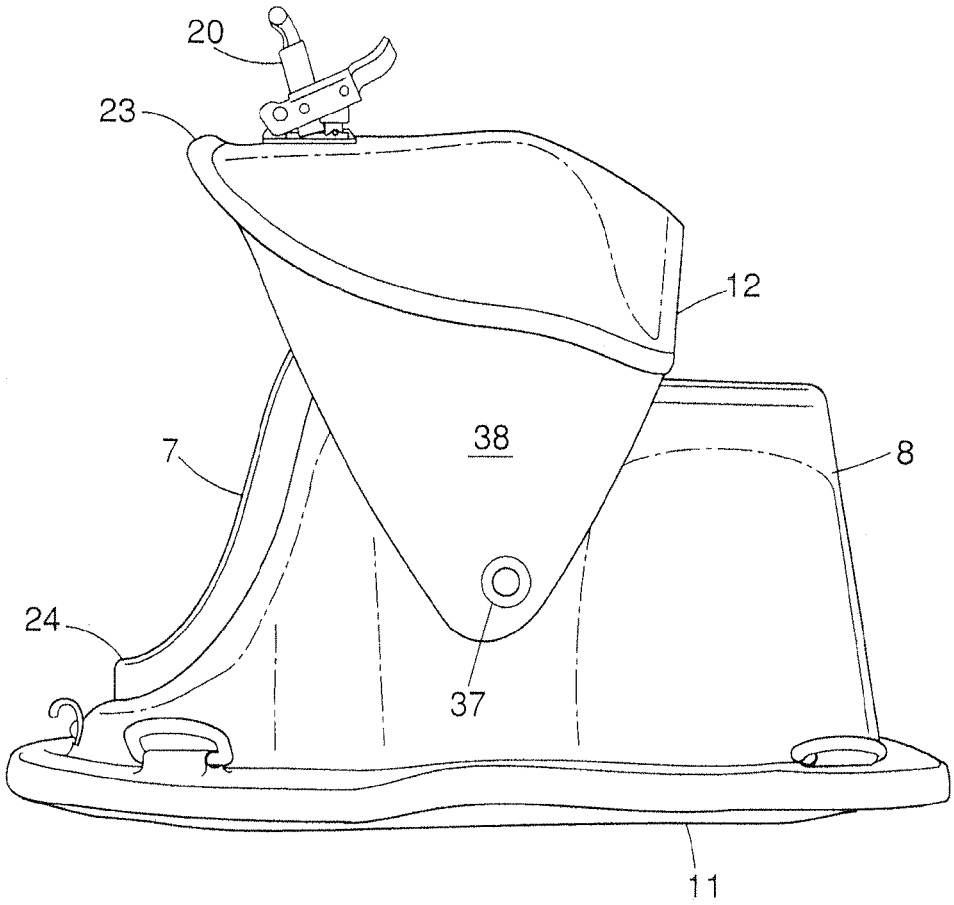
FIG. 11 is a side view of the carrying case with the lid of FIG. 9 in the open position.

In another embodiment of the invention, shown in FIGS. 8-11, a pivoting lid 40 may be attached to a base portion 8 by use of a pivot bracket 35 connected to right and left respective sides of the base portion with pivot hardware 36. The pivoting lid 40 may include a side portion 38 which in some embodiments may be one continuous piece (FIG. 9) or may include a pivot armature or bracket 39 pivoting on a pivot bracket 35 with pivot hardware 36 forming a pivot point assembly 37 (FIG. 10). The lid with connection points on the right and left side of the base portion 8 share a common pivot axis B as shown in FIG. 8. Pivoting allows the lid to open or close to give access to open cavity 7. Pivotal rotation allows the lid to follow spline curve following the contour of the base portion 8. A maximum aperture of the pivoting lid 40 is limited by the respective front leading edge of the top portion 12 of the lid contacting the convex contour 15 of the base portion 8. Closing of the pivoting lid 40 is limited by sealing member 23 of the pivoting lid 40 mating with the sealing member 24 of the base portion 8. Between open and closed position lid orientation, the lid 40 may pivot freely or move by the user overcoming a friction or mechanical staying force being applied by the pivot point assembly 37, allowing for small incremental adjustments to case openness.

While this invention has been particularly shown and described with references to example embodiments thereof, it will be understood by those skilled in the art that various changes in form and details may be made therein without departing from the scope of the invention encompassed by the appended claims.

What is claimed is:

1. A carrying case for camera equipment comprising:

a base portion having a hard outer surface having a forward convex contour with a front reign protruding from a wider convex contour with a top reign, mated to a bottom, and an inner surface, the inner surface being lined with a shock-absorbing material, and an equipment storage cavity defined within the base portion, terminating in an opening, for receiving a camera and at least one camera lens, wherein the back of the camera when received in the equipment storage cavity is positioned closest to the opening, the equipment storage cavity further comprising a recessed edge, the recessed edge forming a gutter in which liquid can flow away from the opening of the base portion, wherein the recessed edge comprises an extended lip;

a lid portion having a hard outer surface with a generally ellipsoidal rear reign and an inner surface, the inner surface being lined with a shock-absorbing material, the lid portion hingedly attached to the base portion; and a sealing member held within the recessed edge framing the opening to form a seal when the lid portion and the base portion are mated, the lid portion sealable with the base portion along a meeting edge curve along the recessed edge, the meeting edge curve and recessed edge being curved, wherein the carrying case comprises two positions, where in the two positions comprise a first vertical position and a second horizontal position, and the meeting edge curve and recessed edge being curved and shaped such that when the carrying case is in the first vertical position with the lid portion positioned upward, the recessed edge drains liquid away from the opening toward the top reign and the front reign, and when the carrying case is positioned to rest on the bottom in the second horizontal position, the recessed edge drains liquid on the carrying case toward the bottom and the liquid is released at the extended lip.

2. The carrying case of claim 1, wherein the hard outer surface is a polymer.

3. The carrying case of claim 1, wherein the hard outer surface comprises a carbon fiber composite.

4. The carrying case of claim 1, wherein the hard outer surface comprises a bio-composite.

5. The carrying case of claim 1, wherein the shock-absorbing material is a protective foam.

6. The carrying case of claim 1, wherein at least a portion of the shock-absorbing material is a flexible bladder.

7. The carrying case of claim 1, wherein the base portion further comprises at least one attachment member.

8. The carrying case of claim 6 further comprising at least one transporting member attachable to the at least one attachment member.

9. The carrying case of claim 8, wherein the at least one transporting member is selected from the group consisting of a removable shoulder strap, a removable chest mounting harness, a removable waist mount strap, a strapping device or a clip.

10. The carrying case of claim 8, wherein the transporting member is a canister comprising a hard outer surface and an inner surface lined with a shock-absorbing material.

11. The carrying case of claim 8, wherein the transporting member is a cargo net.

12. The carrying case of claim 1, wherein the hard outer surface of the lid portion has a convex contour.

13. The carrying case of claim 1, wherein the sealing member is a gasket.

14. The carrying case of claim 1, wherein the sealing member is affixed to the lid portion.

15. The carrying case of claim 1, wherein the sealing member is affixed to the base portion.

16. The carrying case of claim 1, wherein the base portion further comprises a suspension system for securing the camera within the cavity.

17. The carrying case of claim 1, wherein the lid portion is hingedly attached to the base portion at the top of the base portion.

18. The carrying case of claim 1, wherein the lid portion is hingedly attached to the base portion by a pivot bracket secured to opposite sides of the base portion.

19. A carrying case for camera equipment comprising:

a base portion having a hard outer surface having a forward convex contour with a front reign protruding from a wider convex contour with a top reign, mated to a bottom, the bottom comprising first and third hard material layers with a second shock absorbing padding layer therebetween, and an inner surface, the inner surface being lined with a shock-absorbing material, and an equipment storage cavity defined within the base portion, terminating in an opening, for receiving a camera and at least one camera lens, wherein the back of the camera when received in the equipment storage cavity is positioned closest to the opening, the equipment storage cavity further comprising a recessed edge, the recessed edge forming a gutter in which liquid can flow away from the opening of the base portion, wherein the recessed edge comprises an extended lip;

a lid portion having a hard outer surface with a generally ellipsoidal rear reign and an inner surface, the inner surface being lined with a shock-absorbing material, the lid portion hingedly attached to the base portion; and a sealing member held within the recessed edge framing the opening to form a seal when the lid portion and the base portion are mated, the lid portion sealable with the base portion along a meeting edge curve along the recessed edge, the meeting edge curve and recessed edge being curved, wherein the carrying case comprises two positions, where in the two positions comprise a first vertical position and a second horizontal position, and the meeting edge curve and recessed edge being curved and shaped such that when the carrying case is in the first vertical position with the lid portion positioned upward, the recessed edge drains liquid away from the opening toward the top reign and the front reign, and when the carrying case is positioned to rest on the bottom in the second horizontal position, the recessed edge drains liquid on the carrying case toward the bottom and the liquid is released at the extended lip.

* * * * *